US009090966B2

(12) United States Patent
Malkowsky et al.

(10) Patent No.: US 9,090,966 B2
(45) Date of Patent: Jul. 28, 2015

(54) USE OF IONIC LIQUIDS FOR THE PRETREATMENT OF SURFACES OF PLASTICS FOR METALLIZATION

(75) Inventors: Itamar Michael Malkowsky, Hassloch (DE); Aurelie Alemany, Stuttgart (DE)

(73) Assignee: BASF SE, Ludwigshafen (DE)

( * ) Notice: Subject to any disclaimer, the term of this patent is extended or adjusted under 35 U.S.C. 154(b) by 388 days.

(21) Appl. No.: 13/375,955

(22) PCT Filed: Jun. 1, 2010

(86) PCT No.: PCT/EP2010/057602

§ 371 (c)(1),
(2), (4) Date: Dec. 2, 2011

(87) PCT Pub. No.: WO2010/142567

PCT Pub. Date: Dec. 16, 2010

(65) Prior Publication Data

US 2012/0073978 A1 Mar. 29, 2012

(30) Foreign Application Priority Data

Jun. 8, 2009 (EP) ..... 09162184

(51) Int. Cl.

| | |
|---|---|
| ***C25D 5/56*** | (2006.01) |
| ***C23C 18/16*** | (2006.01) |
| ***C23C 18/20*** | (2006.01) |
| ***C23C 18/30*** | (2006.01) |

(52) U.S. Cl.

CPC ..... *C23C 18/1601* (2013.01); *C23C 18/2006* (2013.01); *C23C 18/2046* (2013.01); *C23C 18/30* (2013.01); *C25D 5/56* (2013.01)

(58) Field of Classification Search

CPC ..... C25D 5/56; C25D 5/34; B05D 3/101; C23C 2/02; C23C 18/182; C23C 18/18; C23C 18/2006; C23C 18/2046; C23C 18/1639; C23C 18/1653

USPC ..... 427/322, 404; 205/164, 166, 167, 169

See application file for complete search history.

(56) References Cited

U.S. PATENT DOCUMENTS

| | | | | | |
|---|---|---|---|---|---|
| 3,684,572 | A * | 8/1972 | Taylor | 427/306 |
| 4,517,254 | A | 5/1985 | Grapentin et al. | 428/626 |
| 4,781,990 | A * | 11/1988 | Grapentin et al. | 428/457 |
| 4,873,136 | A * | 10/1989 | Foust et al. | 428/209 |
| 5,145,572 | A | 9/1992 | Hupe et al. | 205/219 |
| 5,597,471 | A * | 1/1997 | Ragge et al. | 205/159 |
| 2005/0147755 | A1 | 7/2005 | Imori et al. | 427/299 |
| 2006/0042954 | A1 * | 3/2006 | Yoshinaga et al. | 205/205 |

FOREIGN PATENT DOCUMENTS

| | | | | |
|---|---|---|---|---|
| CN | 2108279 | | 10/1992 | |
| DE | 31 49 919 | | 6/1983 | |
| DE | 37 43 740 | | 7/1989 | |
| DE | 41 12 462 | | 10/1992 | |
| DE | 4112462 | A * | 10/1992 | C08K 5/3412 |
| DE | 10 2009 003 011 | | 11/2009 | |
| EP | 0 346 655 | | 12/1989 | |
| EP | 1 538 237 | | 6/2005 | |
| JP | 2007162037 | A * | 6/2007 | C23C 18/30 |
| WO | 2004 005391 | | 1/2004 | |
| WO | 2005 113702 | | 12/2005 | |
| WO | 2007 090755 | | 8/2007 | |
| WO | 2008 006422 | | 1/2008 | |
| WO | 2008 043837 | | 4/2008 | |

OTHER PUBLICATIONS

International Search Report Issued Sep. 6, 2010 in PCT/EP10/057602 Filed Jun. 1, 2010.

* cited by examiner

*Primary Examiner* — Edna Wong

(74) *Attorney, Agent, or Firm* — Oblon, McClelland, Maier & Neustadt, L.L.P.

(57) ABSTRACT

Process for coating plastics with metals, wherein the plastics are pretreated with a composition comprising at least one salt having a melting point of less than 100° C. at 1 bar (hereinafter referred to as ionic liquid).

17 Claims, 2 Drawing Sheets

Terluran untreated

Terluran treated with EMIM acetate

Terluran untreated

Terluran treated with MTBS

USE OF IONIC LIQUIDS FOR THE PRETREATMENT OF SURFACES OF PLASTICS FOR METALLIZATION

CROSS-REFERENCE TO RELATED APPLICATIONS

This application is a National Stage of PCT/EP2010/057602 filed on Jun. 1, 2010. This application is based on and claims the benefit of priority to European Application No. 09162184.7 filed on Jun. 8, 2009.

BACKGROUND OF THE INVENTION

The present invention relates to a process for coating plastics with metals, wherein the plastics are pretreated with a composition comprising at least one salt having a melting point of less than 100° C. at 1 bar (hereinafter referred to as ionic liquid).

The coating of plastic parts with metals, also referred to as plastics electroplating, is becoming increasingly important. Processes of plastics electroplating produce composites which combine the advantages of plastics and metals. Plastic can be brought to virtually any shape by simple processing methods such as injection molding or extrusion; subsequent electroplating of the moldings obtained is carried out, for example, for decorative purposes or to achieve shielding effects when the moldings are to serve as housing for electronic devices.

A critical process step in plastics electroplating is the pretreatment of the surface of the plastic. A pretreatment is necessary, inter alia, to improve the adhesion of the metal to the surface of the plastic. For this purpose, the surface of the plastic should be roughened and also more hydrophilic. After roughening was formerly carried out by mechanical methods, swelling and pickling of the surface of the plastic by means of chemicals has become established today for this purpose. The most frequently used pickling solution is chromium/sulfuric acid pickling solution (chromium trioxide in sulfuric acid), in particular for ABS (acrylonitrile-butadiene-styrene copolymer) or polycarbonate.

Chromium/sulfuric acid pickling solution is very toxic and requires special precautions in carrying out the process, aftertreatment and disposal. Owing to chemical processes in the pickling process, e.g. the reduction of the chromium compound used, the pickling solution is consumed and cannot be reused.

Salts having a melting point of less than 100° C. at 1 bar, referred to as ionic liquids, have hitherto been used in a wide variety of industrial fields.

In connection with polymers, use of ionic liquids as antistatics or as plasticizers is known, see WO 2004/005391, WO 2007/090755 and WO 2008/006422. The European patent application 08156462.7 (PF 60856) which had not yet been published on the priority date of the present patent application describes a use of ionic liquids as adhesive for polymers.

It was an object of the present invention to provide a process for coating surfaces of plastics with metals, in which disadvantageous pickling compositions which have hitherto been used are no longer required. The process should produce very good adhesion between plastic and metal. A used pickling composition should be readily reusable and be suitable as a pickling composition for a large number of plastics.

The Ionic Liquid

Figure 1:
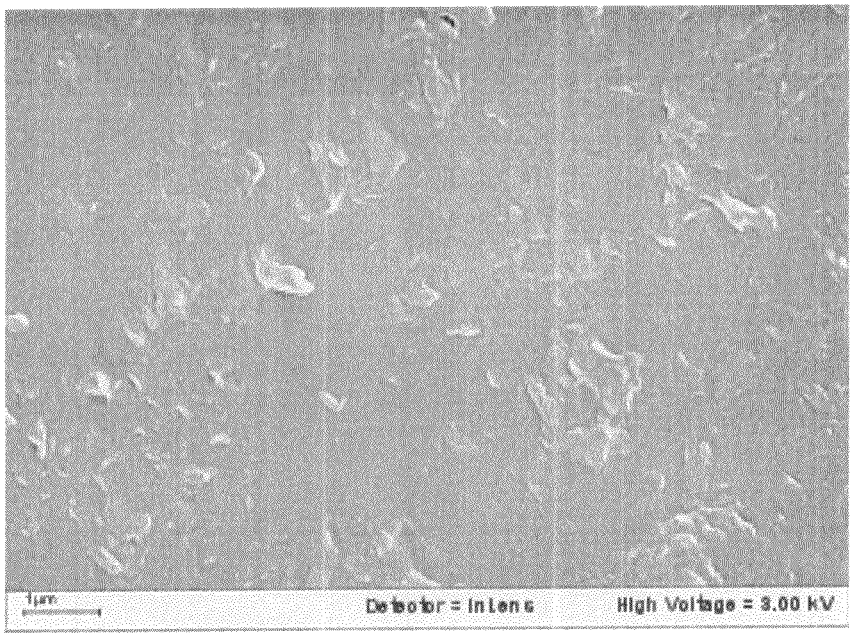
FIG. 1 shows ABS (acrylonitrile-butadiene terpolymer, Terluran® from BASF, with Terluran GP 35 being used in all examples) plates with or without EMIM acetate treatment.
Figure 1:
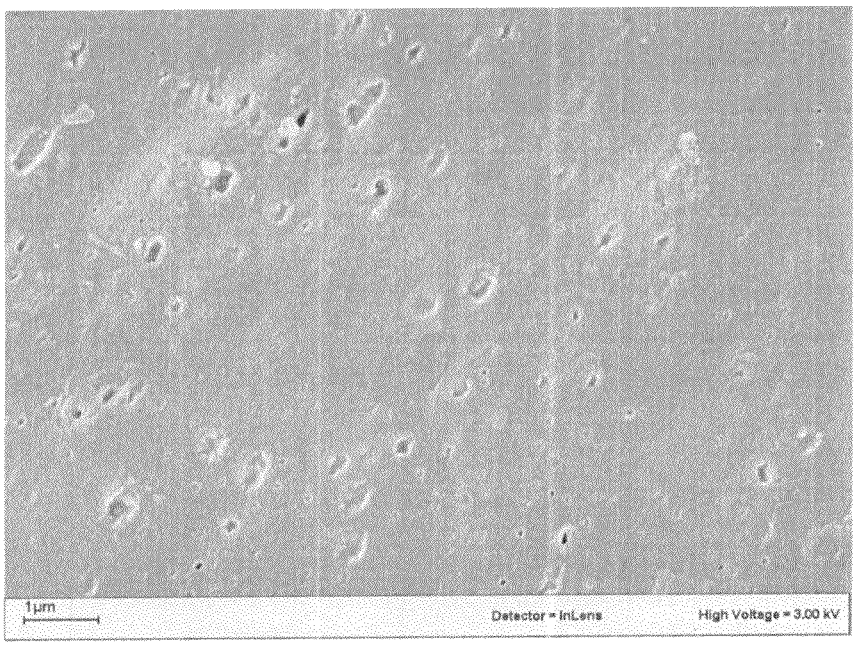

The composition used in the process of the invention comprises at least one salt having a melting point of less than 100° C. at 1 bar (hereinafter referred to as ionic liquid).

The ionic liquid preferably has a melting point of less than 70° C., particularly preferably less than 30° C. and very particularly preferably less than 0° C., at 1 bar.

In a particularly preferred embodiment, the ionic liquid is liquid under normal conditions (1 bar, 21° C.) i.e. at room temperature.

Preferred ionic liquids comprise at least one organic compound as cation, and very particularly preferably comprise exclusively organic compounds as cations.

Suitable organic cations are, in particular, organic compounds having heteroatoms such as nitrogen, sulfur, oxygen or phosphorus, particularly preferably organic compounds having a cationic group selected from among an ammonium group, an oxonium group, a sulfonium group or a phosphonium group.

In a particular embodiment, the ionic liquids are salts having ammonium cations, which term refers here to nonaromatic compounds having a localized positive charge on the nitrogen atom, e.g. compounds having tetravalent nitrogen (quaternary ammonium compounds) or compounds which have trivalent nitrogen and in which one bond is a double bond, or aromatic compounds having a delocalized positive charge and at least one nitrogen atom, preferably one or two nitrogen atoms, in the ring system.

Particularly preferred organic cations are quaternary ammonium cations which preferably have four C1-C12-alkyl groups as substituents on the nitrogen atom.

Particular preference is also given to organic cations which comprise a heterocyclic ring system having one or two nitrogen atoms as constituent of the ring system. Monocyclic, bicyclic, aromatic or nonaromatic ring systems are possible. Mention may be made by way of example of bicyclic systems as are described in WO 2008/043837. The bicyclic systems of WO 2008/043837 are diazabicyclo derivatives, preferably made up of a 7-membered ring and a 6-membered ring, which comprise an amidinium group; mention may be made, in particular, of the 1,8-diazabicyclo[5.4.0]undec-7-enium cation.

Very particularly preferred organic cations comprise a five- or six-membered heterocyclic ring system having one or two nitrogen atoms as constituent of the ring system.

Possible cations are, for example, pyridinium cations, pyridazinium cations, pyrimidinium cations, pyrazinium cations, imidazolium cations, pyrazolium cations, pyrazolinium cations, imidazolinium cations, thiazolium cations, triazolium cations, pyrrolidinium cations and imidazolidinium cations. These cations are mentioned, for example, in WO 2005/113702. If a positive charge on the nitrogen atom or in the aromatic ring system is necessary, the nitrogen atoms are in each case substituted by an organic group which generally has not more than 20 carbon atoms, preferably a hydrocarbon group, in particular a C1-C16-alkyl group, in particular a C1-C10-alkyl group, particularly preferably a C1-C4-alkyl group.

The carbon atoms of the ring system can also be substituted by organic groups which generally have not more than 20 carbon atoms, preferably a hydrocarbon group, in particular a C1-C16-alkyl group, in particular a C1-C10-alkyl group, particularly preferably a C1-C4-alkyl group.

Particularly preferred ammonium cations are the above quaternary ammonium cations, imidazolium cations, pyrimidinium cations and pyrazolium cations, by which are meant compounds having an imidazolium, pyridinium or pyrazolium ring system and optionally any substituents on the carbon and/or nitrogen atoms of the ring system.

Very particular preference is given to imidazolium cations.

The anion can be an organic or inorganic anion. Particularly preferred ionic liquids consist exclusively of the salt of an organic cation with one of the anions mentioned below.

The molecular weight of the ionic liquids is preferably less than 2000 g/mol, particularly preferably less than 1500 g/mol, particularly preferably less than 1000 g/mol and very particularly preferably less than 750 g/mol; in a preferred embodiment, the molecular weight is in the range from 100 to 750 g/mol or in the range from 100 to 500 g/mol.

In a particular embodiment, the ionic liquids are imidazolium compounds, particularly preferably imidazolium compounds of the formula

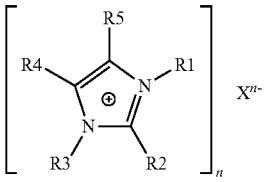

where

R1 and R3 are each, independently of one another, an organic radical having from 1 to 20 carbon atoms, R2, R4 and R5 are each, independently of one another, an H atom or an organic radical having from 1 to 20 carbon atoms, X is an anion and n is 1, 2 or 3.

Preference is given to R1 and R3 each being, independently of one another, an organic group comprising from 1 to 10 carbon atoms. The group is particularly preferably a hydrocarbon group which has no further heteroatoms, e.g. a saturated or unsaturated aliphatic group, an aromatic group or a hydrocarbon group which has both aromatic and aliphatic parts. The hydrocarbon group is very particularly preferably a C1-C10-alkyl group, a C1-C10-alkenyl group, e.g. an allyl group, a phenyl group, a benzyl group. In particular, the hydrocarbon group is a C1-C4-alkyl group, e.g. a methyl group, ethyl group, propyl group, i-propyl group or n-butyl group.

Preference is given to R2, R4 and R5 each being, independently of one another, an H atom or an organic group comprising from 1 to 10 carbon atoms. R2, R4 and R5 are particularly preferably each an H atom or a hydrocarbon group which has no further heteroatoms, e.g. an aliphatic group, an aromatic group or a hydrocarbon group having both aromatic and aliphatic parts. Very particular preference is given to an H atom or a C1-C10-alkyl group, a phenyl group or a benzyl group. In particular, the substituent is an H atom or a C1-C4-alkyl group, e.g. a methyl group, ethyl group, propyl group, i-propyl group or n-butyl group.

The variable n is preferably 1.

As anions, it is in principle possible to use all anions which in combination with the cation lead to an ionic liquid.

The anion $[Y]^{n-}$ of the ionic liquid is, for example, selected from:

the group of halides and halogen-comprising compounds of the formulae:

$F^-$, $Cl^-$, $Br$, $I^-$, $BF^-$, $PF_6^-$, $AlCl_4^-$, $Al_2Cl_7^-$, $Al_3Cl_{10}^-$, $AlBr_4^-$, $FeCl_4^-$, $BCl_4^-$, $SbF_6^-$, $AsF_6$, $^-ZnCl_3^-$, $SnCl_3^-$, $CuCl_2^-$, $CF_3SO_3^-$, $(CF_3SO_3)_2N^-$, $CF_3CO_2^-$, $CCl_3CO_2^-$, $CN^-$, $SCN^-$, $OCN^-$, $NO^{2-}$, $NO^{3-}$, $N(CN)^-$;

the group of sulfates, sulfites and sulfonates of the general formulae:

$SO_4^{2-}$, $HSO_4^-$, $SO_3^{2-}$, $HSO_3^-$, $R^aOSO_3^-$, $R^aSO_3^-$;

the group of phosphates of the general formulae:

$PO_4^{3-}$, $HPO_4^{2-}$, $H_2PO_4^-$, $R^aPO_4^{2-}$, $HR^aPO_4^-$, $R^aR^bPO_4^-$;

the group of phosphonates and phosphinates of the general formulae:

$R^aHPO_3^-$, $R^aR^bPO_2^-$, $R^aR^bPO_3^-$;

the group of phosphites of the general formulae:

$PO_3^{3-}$, $HPO_3^{2-}$, $H_2PO_3^-$, $R^aPO_3^{2-}$, $R^aHPO_3^-$, $R^aR^bPO_3^-$;

the group of phosphonites and phosphinites of the general formulae:

$R^aR^bPO_2^-$, $R^aHPO_2^-$, $R^aR^bPO^-$, $R^aHPO^-$;

the group of carboxylates of the general formula:

$R^aCOO^-$;

the group of borates of the general formulae:

$BO_3^{3-}$, $HBO_3^{2-}$, $H_2BO_3^-$, $R^aR^bBO_3^-$, $R^aHBO_3^-$, $R^aBO_3^{2-}$, $B(OR^a)(OR^b)(OR^c)(OR^d)^-$, $B(HSO_4)^-$, $B(R^aSO_4)^-$;

the group of boronates of the general formulae:

$R^aBO_2^{2-}$, $R^aR^bBO^-$;

the group of carbonates and carbonic esters of the general formulae:

$HCO_3^-$, $CO_3^{2-}$, $R^aCO_3^-$;

the group of silicates and silicic esters of the general formulae:

$SiO_4^{4-}$, $HSiO_4^{3-}$, $H_2SiO_4^{2-}$, $H_3SiO_4^-$, $R^aSiO_4^{3-}$, $R^aR^bSiO_4^{2-}$, $R^aR^bR^cSiO_4^-$, $HR^aSiO_4^{2-}$, $H_2R^aSiO_4^-$, $HR^aR^bSiO_4^-$;

the group of alkyl silane and aryl silane salts of the general formulae:

$R^aSiO_3^{3-}$, $R^aR^bSiO_2^{2-}$, $R^aR^bR^cSiO^-$, $R^aR^bR^cSiO_3^-$, $R^aR^bR^cSiO_2^-$, $R^aR^bSiO_3^{2-}$;

the group of carboximides, bis(sulfonyl)imides and sulfonylimides of the general formulae:

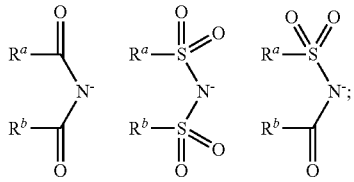

the group of methides of the general formula:

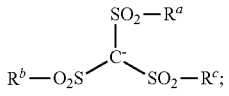

the group of alkoxides and aryloxides of the general formula:

$R^aO^-$;

the group of halometalates of the general formula $[M_rHal_t]^{s-}$, where M is a metal and Hal is fluorine, chlorine, bromine or iodine, r and t are positive integers and indicate the stoichiometry of the complex and s is a positive integer and indicates the charge on the complex;

the group of sulfides, hydrogensulfides, polysulfides, hydrogenpolysulfides and thiolates of the general formulae:

$S^{2-}$, $HS^-$, $[S_v]^{2-}$, $[HS_v]^-$, $[R^aS]^-$, where v is a positive integer from 2 to 10; and the group of complex metal ions such as $Fe(CN)_6^{3-}$, $Fe(CN)_6^{4-}$, $MnO_4^-$, $Fe(CO)_4^-$.

In the above anions, $R^a$, $R^b$, $R^c$ and $R^d$ are each, independently of one another, hydrogen;

$C_1$-$C_{30}$-alkyl and aryl-, heteroaryl-, cycloalkyl-, halogen-, hydroxy-, amino-, carboxy-, formyl-, —O—, —CO—, —CO—O— or —CO—N<substituted derivatives thereof, for example methyl, ethyl, 1-propyl, 2-propyl, 1-butyl, 2-butyl, 2-methyl-1-propyl (isobutyl), 2-methyl-2-propyl (tert-butyl), 1-pentyl, 2-pentyl, 3-pentyl, 2-methyl-1-butyl, 3-methyl-1-butyl, 2-methyl-2-butyl, 3-methyl-2-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2-methyl-3-pentyl, 3-methyl-3-pentyl, 2,2-dimethyl-1-butyl, 2,3-dimethyl-1-butyl, 3,3-dimethyl-1-butyl, 2-ethyl-1-butyl, 2,3-dimethyl-2-butyl, 3,3-dimethyl-2-butyl, heptyl, octyl, nonyl, decyl, undecyl, dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, triacontyl, phenylmethyl (benzyl), diphenylmethyl, triphenylmethyl, 2-phenylethyl, 3-phenylpropyl, cyclopentylmethyl, 2-cyclopentylethyl, 3-cyclopentylpropyl, cyclohexylmethyl, 2-cyclohexylethyl, 3-cyclohexylpropyl, methoxy, ethoxy, formyl, acetyl or $C_qF_{2(q-a)+(1-b)}H_{2a+b}$ where q≤30, 0≤a≤q and b=0 or 1 (for example $CF_3$, $C_2F_5$, $CH_2CH_2$—$C_{(q-2)}F_{2(q-2)+1}$, $C_6F_{13}$, $C_8F_{17}$, $C_{10}F_{21}$, $C_{12}F_{25}$);

$C_3$-$C_{12}$-cycloalkyl and aryl-, heteroaryl-, cycloalkyl-, halogen-, hydroxy-, amino-, carboxy-, formyl-, —O—, —CO— or —CO—O-substituted derivatives thereof, for example cyclopentyl, 2-methyl-1-cyclopentyl, 3-methyl-1-cyclopentyl, cyclohexyl, 2-methyl-1-cyclohexyl, 3-methyl-1-cyclohexyl, 4-methyl-1-cyclohexyl or $C_qF_{2(q-a)-(1-b)}H_{2-b}$ where q≤30, 0≤a≤q and b=0 or 1;

$C_2$-$C_{30}$-alkenyl and aryl-, heteroaryl-, cycloalkyl-, halogen-, hydroxy-, amino-, carboxy-, formyl-, —O—, —CO— or —CO—O-substituted derivatives thereof, for example 2-propenyl, 3-butenyl, cis-2-butenyl, trans-2-butenyl or $C_qF_{2(q-a)-(1-b)}H_{2a-b}$ where q≤30, 0≤a≤q and b=0 or 1;

$C_3$-$C_{12}$-cycloalkenyl and aryl-, heteroaryl-, cycloalkyl-, halogen-, hydroxy-, amino-, carboxy-, formyl-, —O—, —CO— or —CO—O-substituted derivatives thereof, for example 3-cyclopentenyl, 2-cyclohexenyl, 3-cyclohexenyl, 2,5-cyclohexadienyl or $C_qF_{2(q-a)-3(1-b)}H_{2a-3b}$ where q≤30, 0≤a≤q and b=0 or 1;

aryl or heteroaryl having from 2 to 30 carbon atoms and alkyl-, aryl-, heteroaryl-, cycloalkyl-, halogen-, hydroxy-, amino-, carboxy-, formyl-, —O—, —CO— or —CO—O-substituted derivatives thereof, for example phenyl, 2-methylphenyl (2-tolyl), 3-methylphenyl (3-tolyl), 4-methylphenyl, 2-ethylphenyl, 3-ethylphenyl, 4-ethylphenyl, 2,3-dimethylphenyl, 2,4-dimethylphenyl, 2,5-dimethylphenyl, 2,6-dimethylphenyl, 3,4-dimethylphenyl, 3,5-dimethylphenyl, 4-phenylphenyl, 1-naphthyl, 2-naphthyl, 1-pyrrolyl, 2-pyrrolyl, 3-pyrrolyl, 2-pyridinyl, 3-pyridinyl, 4-pyridinyl or $C_6F_{(5-a)}H_a$ where 0≤a≤5; or two radicals form an unsaturated, saturated or aromatic ring which is optionally substituted by functional groups, aryl, alkyl, aryloxy, alkyloxy, halogen, heteroatoms and/or heterocycles and optionally interrupted by one or more oxygen and/or sulfur atoms and/or one or more substituted or unsubstituted imino groups.

In the above anions, preference is given to $R^a$, $R^b$, $R^c$ and $R^d$ each being, independently of one another, a hydrogen atom or a C1-C12-alkyl group.

Very particularly preferred anions are chloride; bromide; iodide; thiocyanate; hexafluorophosphate; trifluoromethanesulfonate; methanesulfonate; formate; acetate; mandelate; nitrate; nitrite; trifluoroacetate; sulfate; hydrogensulfate; methylsulfate; ethylsulfate; 1-propylsulfate; 1-butylsulfate; 1-hexylsulfate; 1-octylsulfate; phosphate; dihydrogenphosphate; hydrogenphosphate; $C_1$-$C_4$-dialkylphosphates; propionate; tetrachloroaluminate; $Al_2Cl_7$—; chlorozincate; chloroferrate; bis(trifluoromethylsulfonyl)imide; bis(pentafluoroethylsulfonyl)imide; bis(methylsulfonyl)imide; bis(p-tolylsulfonyl)imide; tris(trifluoromethylsulfonyl)methide; bis(pentafluoroethylsulfonyl)methide; p-toluenesulfonate; tetracarbonylcobaltate; dimethylene glycol monomethyl ether sulfate; oleate; stearate; acrylate; methacrylate; maleate; hydrogencitrate; vinylphosphonate; bis(pentafluoroethyl)phosphinate; borates such as bis[salicylato(2-)]borate, bis[oxalato(2-)]borate, bis[1,2-benzoldiolato(2−)-O,O']borate, tetracyanoborate, tetrafluoroborate; dicyanamide; tris(pentafluoroethyl)trifluorophosphate; tris(heptafluoropropyl)trifluorophosphate, cyclic arylphosphates such as catecholphosphate $(C_6H_4O_2)P(O)O$— and chlorocobaltate.

Very particularly preferred anions are chloride, bromide, hydrogensulfate, tetrachloroaluminate, thiocyanate, methylsulfate, ethylsulfate, methanesulfonate, formate, acetate, dimethylphosphate, diethylphosphate, p-toluenesulfonate, tetrafluoroborate and hexafluorophosphate.

Particular preference is given to ionic liquids which comprise as cation methyltri(1-butyl)ammonium, 2-hydroxyethylammonium, 1-methylimidazolium, 1-ethylimidazolium, 1-(1-butyl)imidazolium, 1-(1-octyl)imidazolium, 1-(1-dodecyl)imidazolium, 1-(1-tetradecyl)imidazolium, 1-(1-hexadecyl)imidazolium, 1,3-dimethylimidazolium, 1-ethyl-3-methylimidazolium, 1-(1-butyl)-3-methylimidazolium, 1-(1-butyl)-3-ethylimidazolium, 1-(1-hexyl)-3-methylimidazolium, 1-(1-hexyl)-3-ethylimidazolium, 1-(1-hexyl)-3-butylimidazolium, 1-(1-octyl)-3-methylimidazolium, 1-(1-octyl)-3-ethylimidazolium, 1-(1-octyl)-3-butylimidazolium, 1-(1-dodecyl)-3-methylimidazolium, 1-(1-dodecyl)-3-ethylimidazolium, 1-(1-dodecyl)-3-butylimidazolium, 1-(1-dodecyl)-3-octylimidazolium, 1-(1-tetradecyl)-3-methylimidazolium, 1-(1-tetradecyl)-3-ethylimidazolium, 1-(1-tetradecyl)-3-butylimidazolium, 1-(1-tetradecyl)-3-octylimidazolium, 1-(1-hexadecyl)-3-methylimidazolium, 1-(1-hexadecyl)-3-ethylimidazolium, 1-(1-hexadecyl)-3-butylimidazolium, 1-(1-hexadecyl)-3-octylimidazolium, 1,2-dimethylimidazolium, 1,2,3-trimethylimidazolium, 1-ethyl-2,3-dimethylimidazolium, 1-(1-butyl)-2,3-dimethylimidazolium, 1-(1-hexyl)-2,3-dimethylimidazolium, 1-(1-octyl)-2,3-dimethylimidazolium, 1,4-dimethylimidazolium, 1,3,4-trimethylimidazolium, 1,4-dimethyl-3-ethylimidazolium, 3-butylimidazolium, 1,4-dimethyl-3-octylimidazolium, 1,4,5-trimethylimidazolium, 1,3,4,5-tetramethylimidazolium, 1,4,5-trimethyl-3-ethylimidazolium, 1,4,5-trimethyl-3-butylimidazolium or 1,4,5-trimethyl-3-octylimidazolium;

and as anion chloride, bromide, hydrogensulfate, tetrachloroaluminate, thiocyanate, methylsulfate, ethylsulfate, methanesulfonate, formate, acetate, dimethylphosphate, diethylphosphate, p-toluenesulfonate, tetrafluoroborate and hexafluorophosphate.

Furthermore, particular preference is given to the following ionic liquids:

1,3-dimethylimidazolium methylsulfate, 1,3-dimethylimidazolium hydrogensulfate, 1,3-dimethylimidazolium dimethylphosphate, 1,3-dimethylimidazolium acetate, 1-ethyl-3-methylimidazolium methylsulfate, 1-ethyl-3-methylimidazolium hydrogensulfate, 1-ethyl-3-methylimidazolium thiocyanate, 1-ethyl-3-methylimidazolium acetate, 1-ethyl-3-methylimidazolium methanesulfonate, 1-ethyl-3-methylimidazolium diethylphosphate, 1-(1-butyl)-3-methylimidazolium methylsulfate, 1-(1-butyl)-3-methylimidazolium hydrogensulfate, 1-(1-butyl)-3-methylimidazolium thiocyanate, 1-(1-butyl)-3-methylimidazolium acetate, 1-(1-butyl)-3-methylimidazolium methanesulfonate, 1-(1-dodecyl)-3-methylimidazolium methylsulfate, 1-(1-dodecyl)-3-methylimidazolium hydrogensulfate, 1-(1-tetradecyl)-3-methylimidazolium methylsulfate, 1-(1-tetradecyl)-3-methylimidazolium hydrogensulfate, 1-(1-hexadecyl)-3-methylimidazolium methylsulfate or 1-(1-hexadecyl)-3-methylimidazolium hydrogensulfate, 2-hydroxyethylammonium formate or methyltributylammonium methylsulfate.

Constituents of the Composition

The composition according to the invention can comprise further constituents in addition to the ionic liquid.

Possible further constituents are, for example, additives by means of which a desired viscosity is set. Mention may here be made of, in particular, water or organic solvents, with preference being given to water and solvents which are miscible with the ionic liquid. Further additives can be, if appropriate, thickeners or leveling agents.

The composition preferably comprises more than 10% by weight, in particular more than 30% by weight, particularly preferably more than 50% by weight, very particularly preferably more than 80% by weight, of the ionic liquid. In a particularly preferred embodiment, it comprises more than 90% by weight and in particular more than 95% by weight of an ionic liquid. In a very particularly preferred embodiment, the composition consists exclusively of the ionic liquid.

The ionic liquid and composition which comprises or consists of the ionic liquid are preferably liquid over the entire temperature range from 20 to 100° C., in particular from 0 to 100° C. (atmospheric pressure, 1 bar).

The Polymers and Metals

In the process of the invention, plastics are coated. The plastics are preferably thermoplastic polymers. Thermoplastic polymers can be melted and brought to the desired shape by means of various processes such as injection molding, extrusion deep drawing or blow molding.

As suitable thermoplastic polymers, mention may be made of polyamides, polyolefins, polyesters, polyethers, polyacetals, in particular polyoxymethylene, polycarbonate, polyurethanes, polyacrylates, polystyrene or copolymers of styrene, in particular with acrylonitrile, e.g. acrylonitrile-butadiene-styrene copolymer (ABS).

As polyamides, mention may be made of polycondensates of aminocarboxylic acids, e.g. of 6-aminocarboxylic acid or epsilon-caprolactam, or polycondensates of diamino compounds and dicarboxylic acids, e.g. of 1,6-hexanediamine and adipic acid.

Suitable polyolefins are polyethylene, polypropylene and copolymers of ethylene or propylene.

Polyesters are polycondensation products of polyhydric alcohols, e.g. butanediol, hexanediol, glycerol or trimethylolpropane, and polybasic carboxylic acids, in particular phthalic acid and its isomers, adipic acid or trimellitic anhydride.

As polyacetal, mention may be made of, in particular, polyoxymethylene (POM).

Polycarbonates are esters of carbonic acid and polyhydric alcohols, e.g. bisphenol A; mention may also be made of polyester carbonates which comprise further polybasic carboxylic acids as formative components.

Polyethers comprise recurring ether groups. Polyethers of particular industrial importance are, for example, polyetherimides which comprise, in particular, aromatic ring systems linked via recurring ether and imide groups, polyether ketones which, in particular, comprise phenylene groups linked via recurring ether and ketone groups, polyether sulfides which comprise ether and thioether groups in their main polymer chain and polyether sulfones which comprise recurring ether groups and sulfone groups in their main polymer chain.

Polyurethanes are polyadducts of polyfunctional isocyanates and polyhydric alcohols, with both aliphatic and aromatic compounds being possible.

Polyacrylates are homopolymers or copolymers of acrylic monomers or methacrylic monomers; mention may be made by way of example of polymethyl methacrylate (PMMA).

Finally, mention may also be made of homopolymers and copolymers of styrene, e.g. polystyrene, styrene-acrylonitrile copolymer and in particular acrylonitrile-butadiene-styrene copolymers (ABS).

Particularly preferred polymers are polyamides, polyesters, polyethers, polyoxymethylene and ABS. The latter are marketed, for example, under the trade name Terluran® by BASF SE.

The articles to be coated can consist entirely of one of the abovementioned plastics. Such articles can have any shape and can be obtained, for example, by processes of thermoplastic molding such as injection molding, extrusion deep drawing and blow molding. However, they can also comprise various materials; the important thing is that the surface to be coated is composed of plastic.

In the process of the invention, the plastics are coated with metals. Possible metals are, for example, nickel, aluminum, copper, chromium, tin or zinc and also alloys thereof. The metal can be applied in one or more layers or operations. Layers of different metals can also be applied.

The Process

The key element of the process of the invention is the pretreatment according to the claims of the plastics. The coating with the metal and further measures for the procedure, preparation and after-treatment which are necessary or advisable for this purpose may be found in various embodiments in the prior art.

Even before the pretreatment according to the invention, cleaning and degreasing of the plastics surfaces to be coated can be advisable. Such cleaning and degreasing can be carried out using customary cleaners or detergents.

The pretreatment according to the invention replaces the hitherto customary pickling with aggressive chemicals such as chromium/sulfuric acid (chromium trioxide in sulfuric acid).

The pretreatment according to the invention is preferably carried out at elevated temperature, preferably at temperatures of from 30 to 120° C., particularly preferably from 50 to 120° C. The composition preferably has the above temperature for this purpose. Prior separate heating of the plastic part to be coated is not necessary.

In a preferred embodiment, the article to be coated is dipped into the composition which is preferably at the above temperature. The composition is agitated to improve mass transfer, which can, according to the prior art, be carried out by means of stirrers, pumps, blowing-in of air, etc. As an alternative, the workpiece itself can be agitated in the composition by means of specific devices known in electroplating.

The amount of composition required is set so that the workpiece is wetted to the desired extent. The workpiece can be immersed completely or else only partly.

The time for which the composition is allowed to act on the surface of the plastic is preferably 1-60 minutes (min), in particular 1-30 min, particularly preferably 1-15 min.

After the contact time, the composition can preferably be removed from the pretreated article by rinsing with water or an organic solvent.

The composition can be recovered (recycling), if appropriate cleaned and reused.

The recycling of the composition can, for example, be carried out by precipitation of the dissolved plastic by means of water or an organic solvent and subsequent removal of the dissolved plastic by filtration.

The medium or media utilized for the precipitation can subsequently be recovered by distillation. Volatile constituents of the dissolved plastic can also be removed directly from the composition by distillation. In this way, a purified and reusable composition can be obtained.

The pretreatment according to the invention is only part of all the measures which are together referred to as pretreatment in the electroplating of plastics. This term of pretreatment usually summarizes all electroless processes.

This pretreatment includes, in particular, a first application of metal nuclei, e.g. of palladium, silver or gold, preferably palladium, which is also referred to as activation, and a first coating with metals, with the type of activation and the first metal coating being matched to one another.

Known methods of activation are, for example, the classical colloidal activation (application of palladium/tin colloids), ionogenic activation (application of palladium cations), direct metallization or processes which are known under the names Udique Plato®, Enplate MID select or LDS Process.

A further part of the pretreatment is generally also the application of a first metal coating, which is usually carried out in an electroless process. In general, the first layer applied by an electroless process (seed layer) is a layer of nickel, copper, chromium or alloys thereof.

After the pretreatment, metal layers, preferably layers of the abovementioned metals, are finally applied by electrochemical deposition.

The process of the invention enables the adhesion of metal layers to surfaces of plastics, e.g. of ABS, to be improved or, for many plastics, simply to be made possible.

The adhesion of the metal layers which is achieved is very good, even in the case of mechanical stress or high temperatures.

EXAMPLES

1.1 Pickling by Means of EMIM Acetate

A plate of ABS (acrylonitrile-butadiene terpolymer, Terluran® from BASF, with Terluran GP 35 being used in all examples) having dimensions of 60×30×2 mm is precleaned by dipping it into 60 ml of ethanol at room temperature for 2 minutes. The plate is subsequently dipped into 80 ml of stirred 1-ethyl-3-methylimidazolium acetate (EMIM acetate) at 80° C. for 10 minutes. After pickling is complete, the substrate is rinsed with water and dipped into 60 ml of stirred water (dist.) at room temperature for a further 5 minutes in order to remove residual salts. The pickling action of the IL is checked by means of SEM analysis and shows a new structuring of the surface (see FIG. 1).

1.2 Pickling by Means of MTBS

Figure 2:
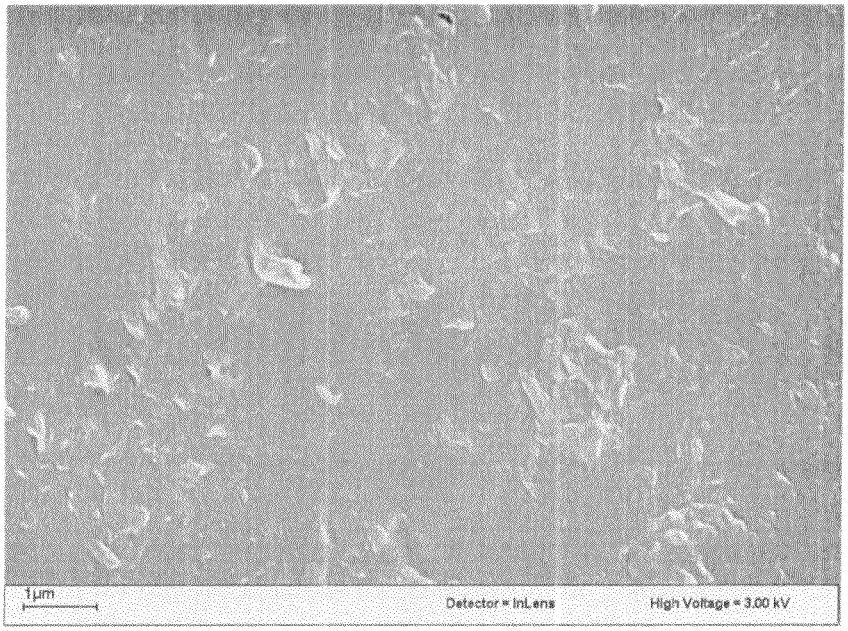
FIG. 2 shows Terluran plates with or without MTBS treatment.
Figure 2:
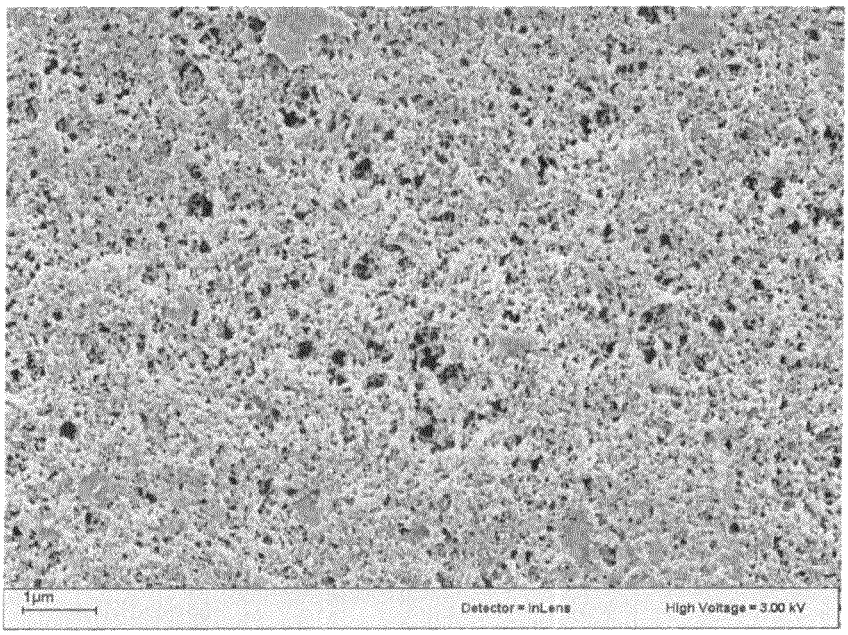

A Terluran plate having dimensions of 60×30×2 mm is precleaned by dipping it into 60 ml of ethanol at room temperature for 2 minutes. The plate is subsequently dipped into 80 ml of stirred methyltributylammonium methylsulfate (MTBS) at 80° C. for 5 minutes. After pickling is complete, the substrate is rinsed with water and dipped into 60 ml of stirred water (dist.) at room temperature for a further 5 minutes in order to remove residual salts. The pickling action of the IL is checked by means of SEM analysis and shows a new structuring of the surface (see FIG. 2).

The invention claimed is:

1. A process for coating a plastic with a metal, the process comprising:

contacting a plastic with a composition comprising an ionic liquid, to obtain a pretreated plastic; and after the contacting, electrochemically depositing at least one layer of a metal on the pretreated plastic, to obtain a coated plastic, wherein:

the ionic liquid is a salt having a melting point of less than 100° C. at 1 bar and comprises an ammonium cation; and a content of the ionic liquid in the composition is more than 50% by weight.

2. The process of claim 1, wherein the ionic liquid is a liquid at 21° C. at 1 bar.

3. The process of claim 1, wherein a content of the ionic liquid in the composition is more than 80% by weight.

4. The process of claim 1, wherein the composition further comprises water or an organic solvent.

5. The process of claim 1, wherein the plastic is a thermoplastic polymer.

6. The process of claim 1, wherein the plastic is a polyamide, a polyolefin, a polyester, a polyether, a polyacetal, a polycarbonate, a polyurethane, a polyacrylate, a polystyrene or a copolymer of styrene.

7. The process of claim 1, wherein the metal is at least one selected from the group consisting of nickel, aluminum, copper, chromium, tin, zinc and alloys thereof.

8. The process of claim 1, wherein the contacting is at a temperature of 30-120° C.

9. The process of claim 1, wherein the plastic is polyoxymethylene.

10. The process of claim 1, wherein the plastic is a styrene-acrylonitrile copolymer.

11. The process of claim 1, wherein the plastic is an acrylonitrile-butadiene-styrene copolymer (ABS).

12. The process of claim 1, further comprising, prior to the contacting, cleaning the plastic.

13. The process of claim 1, further comprising, prior to the contacting, degreasing the plastic.

14. The process of claim 1, further comprising, prior to the contacting, cleaning and degreasing the plastic.

15. The process of claim 1, further comprising applying a metal nuclei, after the contacting and before the electrochemical depositing.

16. The process of claim 1, further comprising, after the contacting, precoating the pretreated plastic with a first metal coating, to obtain a seed layer.

17. The process of claim 1, wherein the ionic liquid is a salt having a melting point of less than 70° C. at 1 bar.

* * * * *